United States Patent [19]

Potts

[11] 4,184,607

[45] Jan. 22, 1980

[54] EASY OPEN CAN END

[75] Inventor: Vinson S. Potts, Cherry Hill, N.J.

[73] Assignee: Crown Cork & Seal Company, Inc., Philadelphia, Pa.

[21] Appl. No.: 7,186

[22] Filed: Jan. 29, 1979

[51] Int. Cl.[2] ..... B65D 41/32

[52] U.S. Cl. ..... 220/273; 220/269

[58] Field of Search ..... 220/268–273; 113/121 C, 121 R

[56] References Cited

U.S. PATENT DOCUMENTS

| | | | |
|---|---|---|---|
| 3,322,296 | 5/1967 | Khoury | 220/273 |
| 3,967,753 | 7/1976 | Cudzik | 220/273 |
| 4,051,976 | 10/1977 | Perry | 220/269 |
| 4,130,074 | 12/1978 | Cudzik | 113/121 R |

*Primary Examiner*—George T. Hall

*Attorney, Agent, or Firm*—Woodcock, Washburn, Kurtz & Mackiewicz

[57] ABSTRACT

This application is concerned with a can end comprising an end plate and a tab, the tab and end plate being so adapted to one another that by bending of the tab up by one desiring to open the can, the tab forces a section of the can to pivot inward, thus allowing access to the contents of the can without detaching any piece of the end or tab. The can end is made of aluminum, and the tab is made of steel coated with a material so chosen as to minimize or eliminate corrosion of the steel. In a preferred embodiment, the steel tab is coated with zinc.

9 Claims, 25 Drawing Figures

EASY OPEN CAN END

BACKGROUND OF THE INVENTION

It has been known for some time in the prior art to provide can ends which can be opened without use of a can opener or other tool. For some years, the most popular can ends of this type were those in which a ring was provided for finger insertion, which when pulled removed a section of the can end along score lines. The ring tab and the removed section of the end were then discarded. This was undersirable for a variety of reasons perhaps chiefly those of unsightly litter; and so a new type of can end was developed which could be opened without the use of tools, but which did not result in any of the components of the can end becoming detached from the can.

Typically in the prior art, such can ends and tabs were both made of aluminum. However, with the well known recent rise in cost of electrical power, aluminum has become a disfavored material for applications where steel can be used, inasmuch as aluminum is, in general, made by electric refining processes which consume enormous quantities of electricity. Therefore, wherever possible, it is desired to substitute steel for aluminum.

In the can end making art, however, steel has been a disfavored material for a number of reasons, chief among those being corrosion. Although steel is preferred for reasons of economy and for certain reasons of ease of manufacture which will be discussed in more detail below, steel has not been a preferred material for tab ends. The present invention involves a steel for tabs coated with a metal chosen to reduce corrosion by means of sacrificial oxidation. It has been found by the applicant that if a steel tab is coated with a material having a higher electronegative potential, that material will be attacked in preference to the steel and if the material is so chosen that a certain amount of oxidation only is permitted, then the tab end will rapidly form its own protective corroded layer which will prevent any further corrosive attacks upon a tab end.

OBJECTS OF THE INVENTION

It is therefore an object of the invention to provide a method whereby a can end can be provided with a tab which is less expensive than those found in the prior art.

A further object of the invention to provide such a tab end which can be made readily and economically without suffering any functional disadvantages compared to those in the prior art.

Still a further object of the invention is to provide a tab end of steel which is not attacked by corrosion.

SUMMARY OF THE INVENTION

In accordance with the above needs of the art and the objects of the invention, a can end is provided with a steel tab as an integral part of the can end. The tab is coated with a metal chosen so as to be preferentially corroded over the steel, and which is only corroded to a certain depth below its surface, thus providing a limitation on the total amount of corrosion suffered by the tab end. In the preferred embodiment the coating material is zinc; another possibility would be aluminum.

DESCRIPTION OF THE PREFERRED EMBODIMENTS

Figure 2:
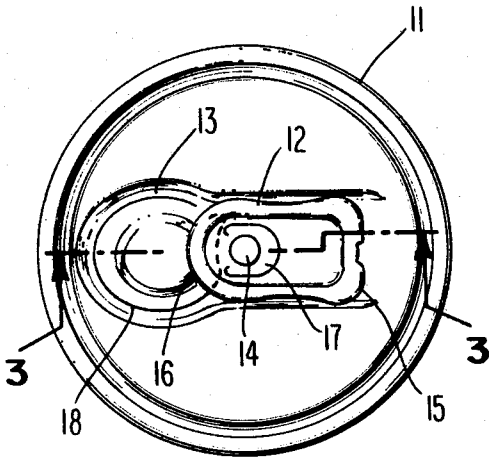
FIG. 2 shows a top view of such a can end.
Figure 3:
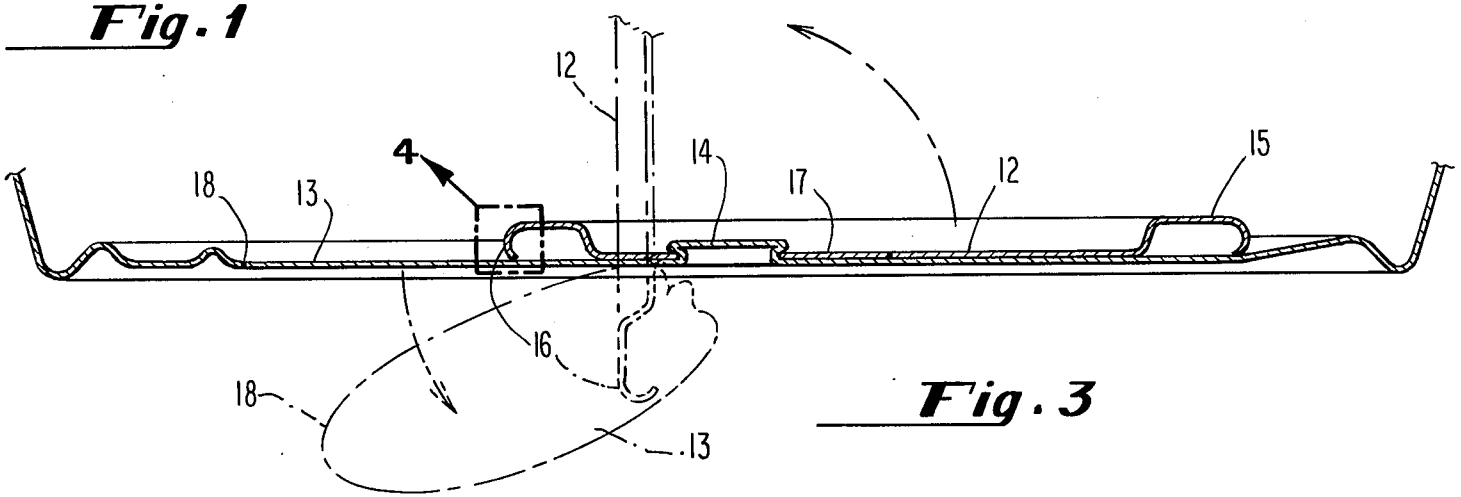
FIG. 3 shows a cross-section at an enlarged scale of such can end.
Figure 1:
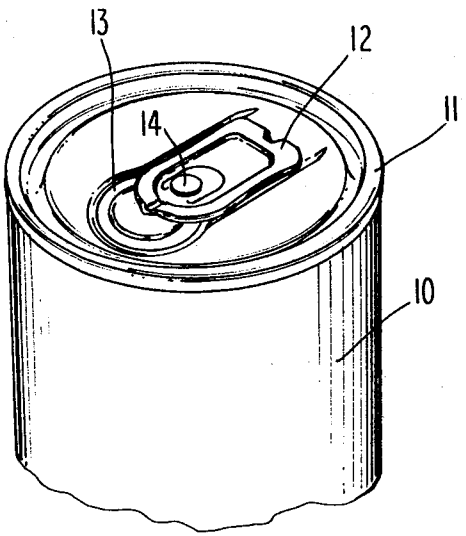
FIG. 1 shows a perspective view of the top of a can with a can end according to the invention attached.

Understanding of the can end of the invention and the method of making it will be better understood by reference to the figures appended hereto. Referring now to FIG. 1, a can 10 is shown provided with an end 11 having attached thereto a tab 12 and having marked thereon a segment 13 of the end 11 which, upon elevation of the end of tab 12 by a consumer of the contents of the can 11, is adapted to pivot into the interior of the can 11, thus opening the can 11. Referring now to FIGS. 2 and 3, the method of operation of the can end of the invention will be described in detail. In these figures, the can end 11 is shown in FIG. 2 in an elevation, and FIG. 3 in a partial cross-section. It will be observed that the tab 12 is attached to the can end 11 by means of a rivet 14 integrally formed from the material of the can end 11. Upon the insertion of the user's finger under rounded end 15 of the tab 12, the tab 12 tends to pivot about the shortest part of its junction with a hinge member 17. As will be discussed in further detail hereinafter, the hinge member 17 is formed integrally with the tab 12, but is cut therefrom nearly entirely around its circumference, so as to provide a hinging section about which the tab 12 can pivot. When the tab 12 pivots about this hinge member 17, as shown in phantom in FIG. 3, extension portion 16 exerts a downward force on the openable section 13 of the can end 11, thus forcing this section 13 into the interior of the can 10, thus providing an opening through which the contents of the can 10 may be withdrawn. In order that the openable section 13 is not detached from the can end 11 during this operation, it is provided with a score line which runs most of the way around its circumference, but not entirely. Thus, when a force is applied to it by the extension 16 by the application of pressure by the user at 15, the openable portion 13 is detached along the scoreline 18 and pivots about the unscored section of its circumference by which it remains attached to the can end 11.

Up to this point, the description in this preferred embodiments of the invention section of this specification has been of material which is all in the prior art. However, no mention has yet been made of materials used to make can ends and tabs, which applicant has discovered to be of cardinal importance. In particular, the prior art cans and tabs have all been made of aluminum material which, while reasonably well suited to the purpose, is expensive due to the large quantities of electricity required for its refinement. Therefore, and as suggested above, it is desirable to replace as much of the aluminum as possible with some less expensive material such as steel.

It would be desirable, of course, to make the entire can end 11 of steel; however, it turns out that it is not possible to score steel, for example, around the periphery of operable portion 13 along line 18, due to the high tensile strength and ductility of the low cost steel which is sought to be used in this sort of application. The applicant has found, however, that the tab can possibly be made of steel if and only if it is coated with a material which will prevent it from being corroded. It is found that steel is corroded particularly readily when in intimate contact with aluminum, as is the case here. Therefore, good corrosion prevention is particularly important. Moreover, steel has other than economic advantages over aluminum in this application because the portion of the tab which connects the protrusion 16 and the handle 15 with hinge member 17 about which the tab pivots is far tougher when made of steel than it would be when made of aluminum. This increased toughness eliminates breakage of this hinge section which can, when the tab is of aluminum, be a problem; that is, the tab can break off without opening portion 13 of the can, which is clearly undesirable. The constraint on one seeking to make a steel tab for a beverage can is that it must be of a steel which will withstand exposure to a variety of contaminants and which, under such circumstances, will not be corroded. The applicant has found that this objective can be satisfied by manufacturing the tab of a steel which is coated with a material which will be corroded in preference to the steel, and which has only surface corrosion properties so that once the surface is corroded by exposure to various reactant materials, corrosion will stop. By comparison, it is well known that steel corrodes from the inside of a mass thereof rather than simply on the surface so that, for example, a piece of solid steel can rust through. On the contrary, a mass of, for example, aluminum is corroded only on the surface and only in a very thin layer, so that once the layer has formed, no further corrosion is possible.

It will be clear to those skilled in the art that manufacturing the tab out of steel coated with a corrosion preventive material will be effective as to those surfaces of the steel which are exposed when the coating is applied to the steel. However, if tabs are sheared or stamped from a sheet of steel after having been coated, it would appear that the edges of the stamped tab would not be covered with the coating, and therefore would be liable to corrosion. Applicant has found, however, that if the stamping operation is properly designed and operated, the coating can be made to cover a considerable fraction of the edge of the tab, thus preventing corrosion from attacking the tab at any point.

Figure 4:
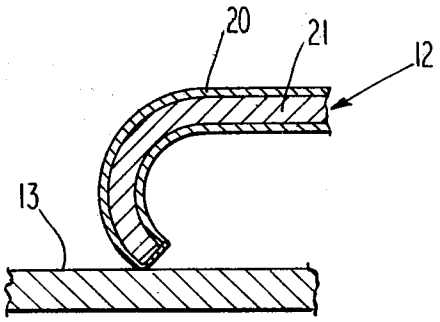
FIG. 4 shows a detail of the anti-corrosive coating applied to the tab.

Referring now to FIG. 4, a section corresponding to that identified by the box labeled "4" in FIG. 3 is shown in greater detail. There, a section of tab 12 is shown abutting against can top 13. Can top 13 is of aluminum and tab 12 is formed from sheet of steel 21, which is coated all around with a layer of corrosion-reducing metal 20. In this way, it can be assured that the tab will not be attacked by corrosion and will not contaminate any beverage or any other material contained within the can.

Figure 5:
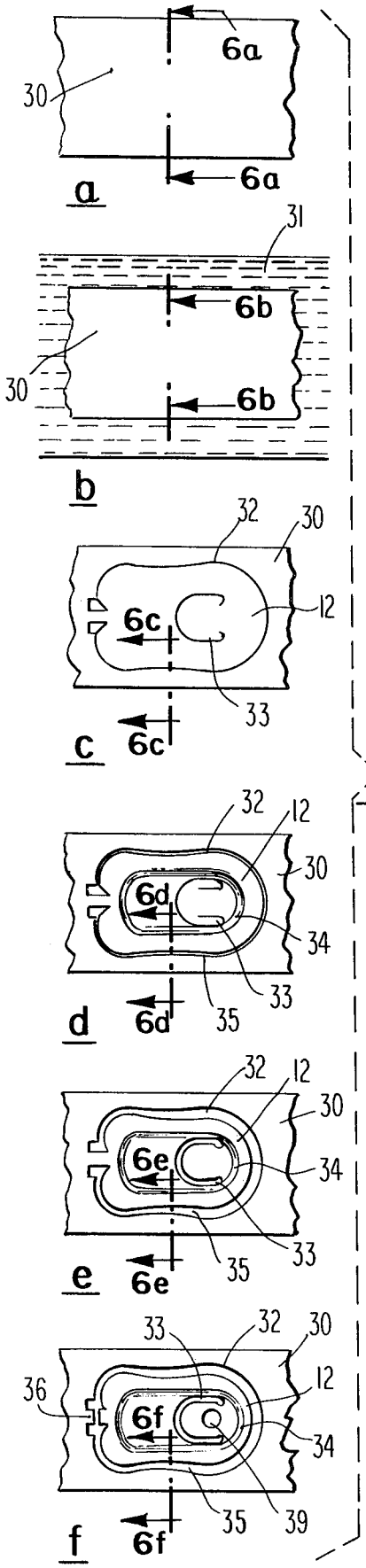
FIGS. 5A to 5F and 6A to 6F show a sequence of stages in the formation of the tab of the invention.
Figure 6A:
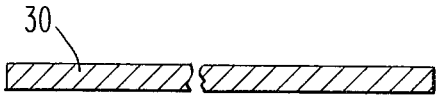
Figure 6B:
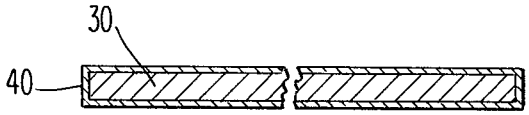
Figure 6C:
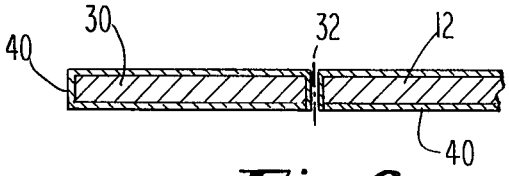
Figure 6D:
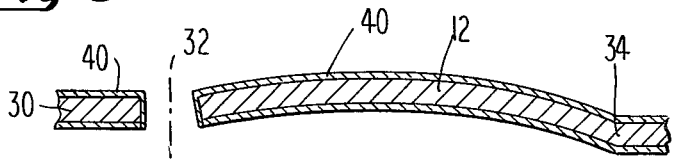
Figure 6E:
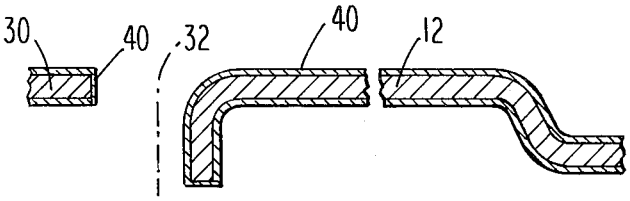
Figure 6F:
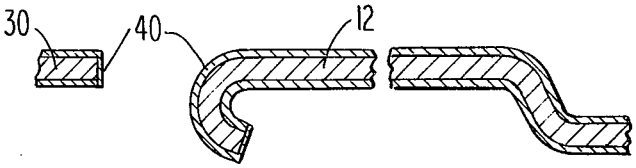

FIGS. 5A through 5F and 6A through 6F show corresponding stages in the manufacture of such tabs. FIGS. 5A through 5F show elevations, and 6A through 6F show cross-sections of the tab as it is formed and as marked in FIGS. 5A through 5F. Thus, FIGS. 5A and 6A show a steel strip 30 prior to any processing leading to the manufacture of such a can tab. FIG. 6B shows a cross-section of the strip after such coating where this strip 30 has now been covered with a layer of zinc 40. FIG. 5C shows the first stamping stage which may profitably be used to form the tab. There, the tab outline 32 is shown having been formed in the strip 30 resulting in a general outline of tab 12 having a hinged section 33. In FIG. 6C, it is shown how the tab 12 coated with a layer of zinc 40 is separated from the strip 30, also coated with a layer of zinc 40, by a gap 32 which defines the periphery of the tab. It will be observed that the coating 40 is shown as having been drawn into the gap 32. It has been found by applicant that this drawing operation is effected when the dies defining the gap 32 are not too tightly fitted; that is, if, for example, the strip is stamped into tabs by a vertical process where the strip is advanced horizontally through a press and a die descends vertically upon the strip, the zinc will not be drawn into the gap thus formed as well when the die fits tightly into the die cavity as it will when the die has a certain amount of clearance with the die cavity. In FIG. 5D, the next stage in the process of manufacture of the tab is shown. There, the gap 32 has become wider and better defined, due to the curvature of the section of the periphery of the tab as shown in FIG. 6D. Furthermore, the hinged section 33 has been better defined, and a rim 34 has been formed around the inner portion of the curved section of the periphery, again referring to FIG. 6D. In FIGS. 5E and 6E, the tab 12 is shown still further defined, the edge of the tab 35 has been tucked under, and the gap 32 has been widened considably. Throughout these stages, the tab 12 remains attached to the strip 30 by a tag at its left for ease of processing. Thus, the strip 30 with its coating 40 is shown along with tabs in FIGS. 5O. In FIG. 5F, the tab is shown in a finished form. There, the rim of the tab 12 has been tucked under so as to provide a smooth surface for the user's finger; consequently, the gap 32 has widened still further. The rim around the hinge section of the tab 34 has been raised, and the tab has been finally detached from strip 30 by punching at strip 36. The tab thus made can be attached to a can lid by processes well known in the art where a rivet is integrally formed out of the can top 11 through a hole 39 punched in the hinged section of the tab as shown in FIG. 3.

Figure 7:
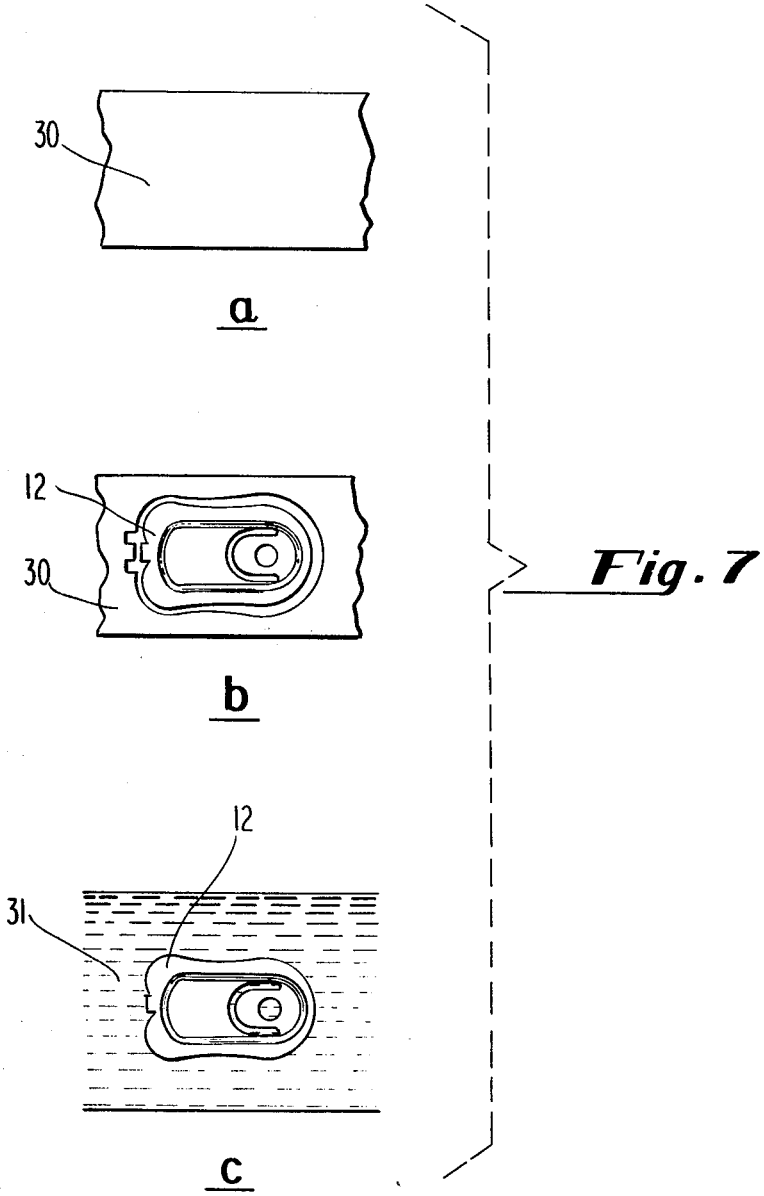
FIG. 7 shows a partial sequence of operations according to another embodiment of a process for making the tab of the invention.
Figure 8:
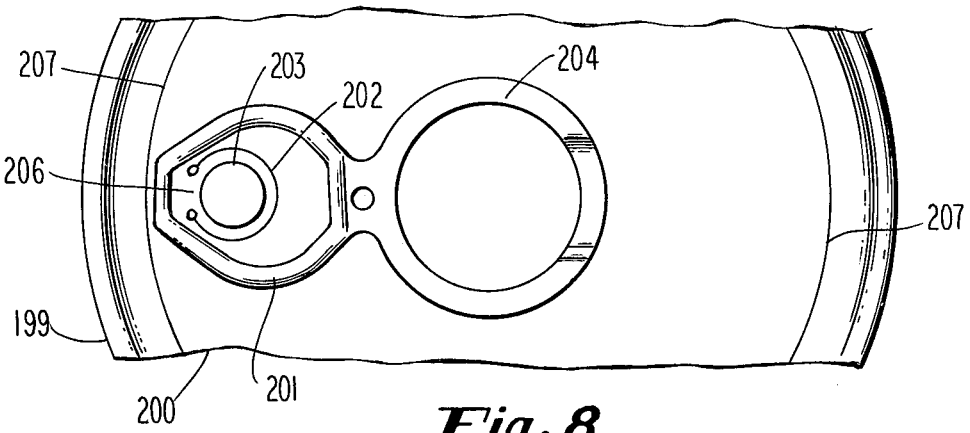
FIGS. 8,9,10 and 11 show other embodiments of can ends which can be made according to the invention.

FIG. 7 shows another process for making such a coated steel tab. There, a strip 30, FIG. 7A, is formed into a tab, FIG. 7B, as discussed above. However, in this case, strip 30 was not coated prior to formation of tab 12. Instead, after formation the tab is dipped into a bath of molten metal 13, FIG. 7C, thus coating all surfaces, edges as well as flat surface, with essentially a uniform layer of anti-corrosive coating.

FIGS. 8,9,10 and 11 show alternative embodiments of can ends wherein the invention is also useful. In the can end of FIG. 8, a tab 201 is provided with a ring 204 and attached to a can top 200 by means of a rivet 203. Around rivet 203 is a cut line 202 which extends entirely through the tab, but which is left with an uncut area 206. When the ring 204 is picked up by the consumer of the contents of the can, the tab pivots about this area 206, thus cutting loose the can top 200 from its rim 199 along score line 207 which extends all the way around the top of the can. Again, the entire tab 201 may be made of steel coated with a protective metal in accordance with the invention while the top 200 and rim 199 may be made of aluminum.

Figure 9:
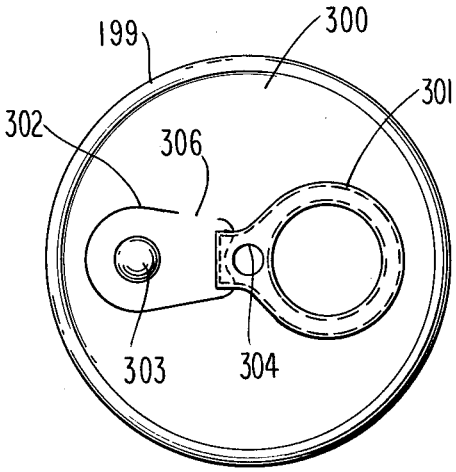

In FIG. 9, another embodiment of a can top and tab is shown. There can 199 is provided with a top 300 to which is riveted, by means of rivet 304, a tab 301. A score line 302 is indented into can top 300, but provided with a blank space 306. Upon picking up of the ring portion of tab 301 by a consumer, the tab pivots about rivet 304, thus pressing down on the opening area, which is defined by score line 302, which pivots about area 306 into the center of the can, thus allowing access to its contents. A finger depression 303 may be provided in case the tab 301 does not push the openable section of the top far enough into the can for complete access.

Figure 10:
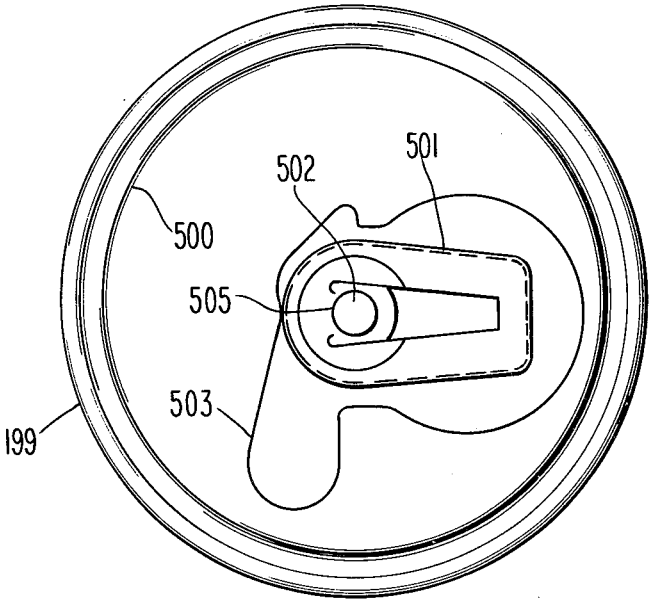

In FIG. 10, yet another can top which can be improved by the use of the present invention is shown. The can 199 is provided with tab 501 and a completely circumferential score line 503. Tab 501 is attached by means of rivet 502 to the top of the can 500. Upon picking up of the rightmost end, as shown in the drawing, of tab 501, it pivots about uncut area 505, thus exerting a localized force on the section of the scoreline 503 nearest to tab 501, thus initiating a break around the scoreline which can be completed by application of pressure directly by the use of the consumer's finger.

Figure 11:
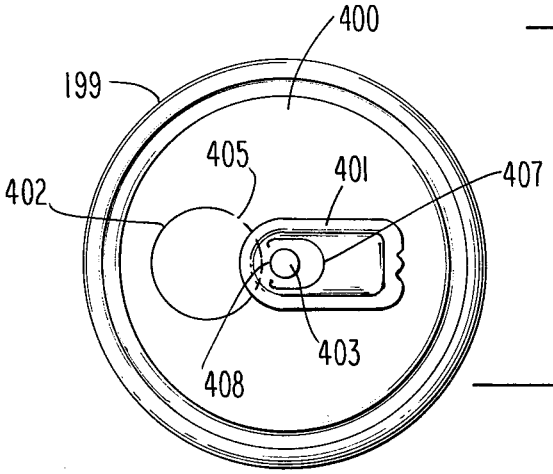

Finally, FIG. 11 shows yet another embodiment of the invention which is somewhat similar to that described above in connection with FIGS. 1,2 and 3. Here, can 199 is provided with a top 400 which is attached tab 401 by means of rivet 403. A scoreline 402 is provided which is almost completely circular in outline, but in which is left an unscored region 405. Tab 401 is divided into a handle portion and a hinge portion 406 by a cut line 407 which is not a complete cut. By virtue of the uncut area 408, when a consumer picks up the right end of a tab, it tends to pivot about area 408, thus exerting a downward force on the removable section of the can which in turn pivots about area 405 into the interior of the can 199 thus allowing access to the contents of the can 199.

It will be appreciated that all the embodiments of FIGS. 8, 9, 10 and 11, as well as that shown in FIGS. 1, 2, and 3 can be improved by the use of a tab formed with steel coated with a corrosion-preventive material according to the invention. In each case money can be saved by using such a tab of coated steel rather than the aluminum which is found in the prior art; for example, in U.S. Pat. Nos. 3,322,296, 4,051,976 and 3,967,753 in which embodiments are shown very much like FIGS. 8, 9, and 10 respectively. Furthermore, in each of these designs considerable stress is put upon the tab when operated, which can be much better handled without failure if the tab is steel than if it is aluminum.

Figure 12:
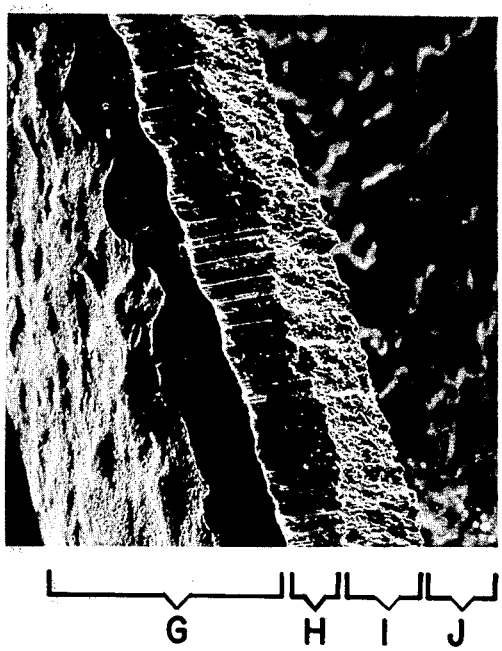
FIGS. 12 through 15 are photomicrographs showing the details of the coating.
Figure 13:
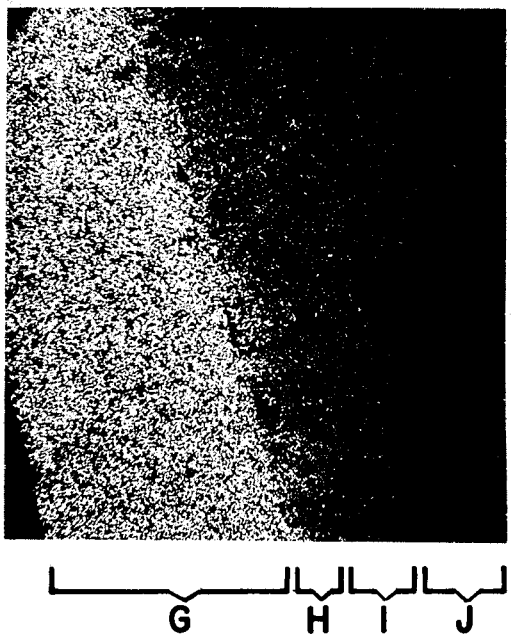

It was discussed earlier in this specification that it is of importance that the edges of the coated steel tab be also coated with a corrosion preventive material if corrosion of these edges is to be avoided, and it was shown in FIGS, 4, 5, and 6 and the discussion thereof how, through careful die design, this could be achieved even if the tab is formed after the strip which it is formed is coated. FIGS. 12 through 15 are photomicrographs of tabs made in accordance with this invention which show that the zinc coating from the planar surface of the tab is "washed over" onto the edge of the tab during the forming process. This effect can be observed from a comparative study of FIGS. 12 and 13. FIGS. 12 and 13 are photographs of the same tab in the same position, but FIG. 12 is a scanning electron micrograph at 120 power magnification, while FIG. 13 is a so-called X-ray map view of the same tab at the same magnification. This is done so that corresponding zones of the scanning electron photograph can be compared with the X-ray may for precise identification of the various areas of the X-ray map. Thus, in both FIGS. 12 and 13, the edge of a coated steel tab is shown identified as areas H and I. Area G is the planar surface of the tab, which is curved, as can be seen from FIG. 12, during the forming process. Area J is the interior surface of the curved tab. Thus, the edge is one which might correspond to that shown, for example, in FIG. 4. It will be observed from a comparison of FIGS. 13 and 12 that the zinc, which is identified in FIG. 13 by white dots, the density of the dots indicating the thickness of the zinc coating, that while coverage of the zinc on the cut edge of the tab in Areas A and I is not as thick as it is in the surface which was exposed when the tab was dipped prior to forming, that is, area G, a considerable amount of zinc is nonetheless present on the cut edge, areas H and I, due to it being washed over by the forming process; by the action of a comparatively loosely fitting punch in a die.

Figure 14:
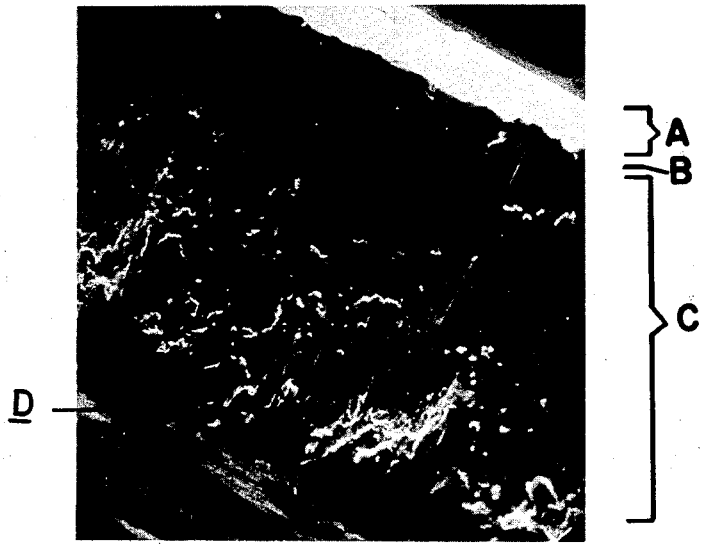
Figure 15:
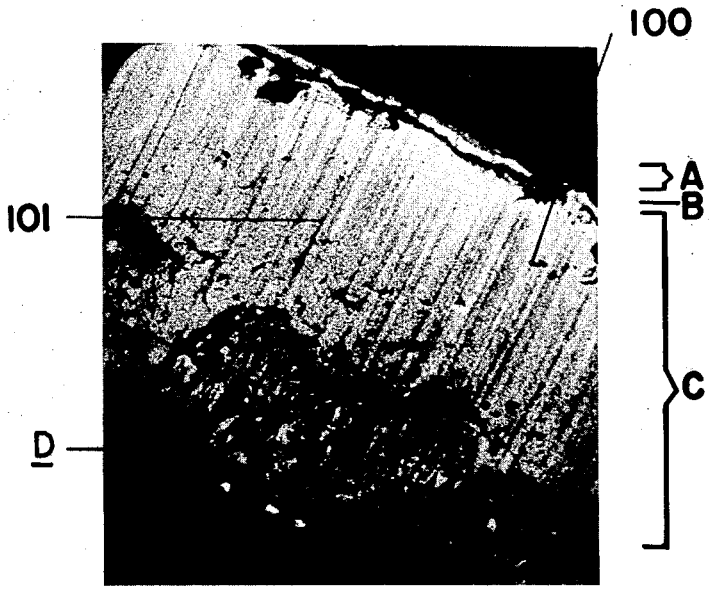

Referring now to FIGS. 14 and 15, a second form of modern metallurgical equipment has been used to make essentially the same point. In FIG. 14 we see once again a scanning electron micrograph of the edge of a tab; the magnification is now 300-fold, so that the tab is presented in considerably more detail. In both FIGS. 14 and 15, area A represents the top or planar surface of the tab. Area B is the corner, so to speak, between the planar surface and the cut edge, and area C and D are the edge itself. Area C shows a comparatively smooth cut, while area D is a portion of the edge which has been comparatively roughly torn away from the strip by the stamping process. FIG. 15 shows a backscattered electron image of the same tab edge section shown in FIG. 14 and at the same magnification. It will be observed that the edge C and D is in two shades, a lighter, whitish shade and a darker, grayer shade marked respectively 100 and 101. The areas are so colored because of differences in material. In essence, the area marked "100," the lighter area, is so colored due to a coating of zinc thereon, whereas the gray area 101 is essentially iron based (i.e., steel). While the zinc area 100 clearly does not extend uniformly over the entire area of the edge C and D, it is equally clear that the zinc does provide a substantial amount of coating to the iron. In any case, it has been found by the inventor that the edges of the tabs do not tend to corrode, which is, of course, the end to be sought. It appears from study of FIGS. 13 and 15 that the coating covers some 10–20% of the edge, and that this would appear to be sufficient.

It will be appreciated that due to the electrochemical nature of the protective mechanism, a full coating of protective metal may not be necessary in order to give adequate protection to the steel. That is, the protection is in the nature of a preferential chemical reaction between the zinc and the corrosive agents in the environment to which the can end is subjected, rather than the iron. Thus, full coating may not be required for full protection. From this it will be apparent that any metal having a more preferential reaction with such agents than iron will be a suitable coating; that is, any element having a higher electronegativity than iron will be suitable in place of the zinc. Zinc is used in the preferred embodiment simply because it is cheap and can readily be applied by, e.g., dipping.

Those skilled in the art will recognize that a number of modifications can be made to the invention as disclosed in the above without departing from its essential concept; that is, the can end can be made entirely from such steel coated from aluminum, but as discussed above, it is believed that in most applications the can end itself will be made of aluminum and the tab will be made of steel coated with a metal with a higher electronegativity, and the invention has been described in terms of these materials. Moreover, it will be clear that the zinc or other metal coating can be applied by any suitable process at any suitable step in the formation of the tab. Moreover, it will be apparent that a further coating can be also be added in order to prevent, for example, the zinc from being scraped off during later processing. Preferably a lacquer is used to protect the zinc during further handling.

Therefore, this description of the invention should not be construed to limit it, inasmuch as it is exemplary only; rather, the invention's scope should be determined only by the limitations expressed in the following claims.

What is claimed is:

1. A can end comprising an end plate and a tab, said end plate being formed of aluminum and having formed therein a rivet to which the tab is attached, said tab being formed of steel and having a coating thereon of a metal preferentially corrodible with respect to the steel.

2. The can end of claim 1 wherein said tab is formed by stamping from a sheet of steel coated with said preferentially corrodible metal.

3. The can end as claimed in claim 1 where said preferentially corrodible metal is zinc.

4. The can end as claimed in claim 1 where said preferentially corrodible metal is aluminum.

5. The can end according to claim 1 wherein said coating at least partially covers the edges of said tab.

6. The can end as claimed in claim 5 wherein said coating covers at least ten percent of the edges of the tab.

7. The can end according to claim 5 wherein the coating is caused to adhere to the edge of the tab by dipping the previously formed tab in a bath of the preferentially corrodible metal.

8. The can end according to claim 5 wherein the coating is formed around the edge of the tab by drawing the coating from the planar surface of the tab during the forming operation.

9. A can end comprising an end plate and a tab, wherein both end plate and tab are formed of steel coated with a layer of a metal selected from the group consisting of aluminum and zinc, and wherein the metal coating is further coated with a layer of a protective lacquer.

* * * * *